169-46 SR

3/31/87 XR 4,653,396

United States Patent [19]

Wennerberg

[11] Patent Number: 4,653,396

[45] Date of Patent: Mar. 31, 1987

[54] RECIRCULATING AIR CALENDER ROLL CONTROLLER

[75] Inventor: Gunnar Wennerberg, Cupertino, Calif.

[73] Assignee: Measurex Corporation, Cupertino, Calif.

[21] Appl. No.: 731,661

[22] Filed: May 7, 1985

[51] Int. Cl.[4] ..... B30B 15/34; B30B 3/04

[52] U.S. Cl. ..... 100/38; 100/47; 100/93 RP; 100/168; 100/162 B; 29/116 AD; 219/10.41; 219/354; 219/470; 34/25; 34/41; 169/5; 169/46; 169/54

[58] Field of Search ..... 100/38, 47, 93 RP, 917, 100/168, 162 B; 219/10.41, 10.43, 10.57, 10.61 R, 10.71, 10.73, 354, 470, 469, 388; 34/48, 54, 41, 4, 25; 29/116 A.D., 113 A.D.; 72/13, 16, 200, 201, 236; 169/543, 46, 54

[56] References Cited

U.S. PATENT DOCUMENTS

| | | | |
|---|---|---|---|
| 2,415,025 | 1/1947 | Grell et al. . | |
| 2,981,175 | 4/1961 | Goyette . | |
| 3,177,799 | 4/1965 | Justus et al. . | |
| 3,190,212 | 6/1965 | Moore | 100/93 RP X |
| 3,203,678 | 8/1965 | Sawyer et al. . | |
| 3,266,561 | 8/1966 | Beachler et al. | 100/93 RP X |
| 3,413,915 | 12/1968 | Goodwin et al. . | |
| 3,438,088 | 4/1969 | Westbrook et al. . | |
| 3,456,582 | 7/1969 | McClenathan . | |
| 3,521,325 | 7/1970 | Schippers et al. . | |
| 3,556,000 | 1/1971 | Goodwin et al. . | |
| 3,702,912 | 11/1972 | Greenberger . | |
| 3,770,578 | 11/1973 | Spurrell . | |
| 3,772,492 | 11/1973 | Brogden et al. . | |
| 4,114,528 | 9/1978 | Walker . | |
| 4,384,514 | 5/1983 | Larive et al. . | |
| 4,425,489 | 1/1984 | Pav et al. . | |
| 4,514,913 | 5/1985 | Stephansen | 34/41 X |
| 4,573,402 | 3/1986 | Sharma et al. | 100/162 B |

FOREIGN PATENT DOCUMENTS

| | | |
|---|---|---|
| I143039 | 3/1983 | Canada . |
| 575567 | 4/1958 | Italy . |
| 67827A81 | 6/1981 | Italy . |
| 977098 | 12/1964 | United Kingdom . |

OTHER PUBLICATIONS

Pulp & Paper Magazine, Nov. 1984, pp. 54–55.
Pulp & Paper Magazine, Dec. 1984, p. 157.

*Primary Examiner*—Peter Feldman
*Attorney, Agent, or Firm*—Spensley, Horn, Jubas & Lubitz

[57] ABSTRACT

The present invention is directed toward a controller for controlling local calender roll diameters by directing temperature controlled fluid against selected slices of a rotating calender roll. The calender roll has a diameter which responds to changes in temperature. Therefore, thermal expansion or contraction, resulting from localized heating or cooling of the calender roll by the temperature controlled fluid, corrects local non-uniformities in the spacing between cooperating calender rolls. The invention conserves energy by recirculating the temperature controlled air.

20 Claims, 4 Drawing Figures

RECIRCULATING AIR CALENDER ROLL CONTROLLER

BACKGROUND OF THE INVENTION

The present invention relates to the field of calenders, and more particularly to devices for controlling the diameter of rolls used in calenders or analagous machines.

Pressing a material between two calender rolls can change the physical characteristics of the material. For example, calendering paper changes its density, thickness and surface features. Thus, the calendering process is frequently used in the manufacture of paper and other sheet materials where it is often desirable to change the density, thickness or surface features of the material.

A common problem associated with calendering is the uneven thickness of the calendered material or "web." Localized variations in a variety of parameters affect the diameter of individual calender rolls and create variations in the spacing or "nip" between cooperating rolls. Variations in the nip across the width of a pair of calender rolls produces a web having non-uniform thickness. Thus, a more uniform web thickness could be obtained if the local diameters of the calender rolls could be controlled.

If a calender roll is made of a material that responds to changes in temperature, one may control local roll diameters by varying the temperature of selected cylindrical sections or "slices" of the roll. Previous devices have used this principle by directing jets of hot or cold air against slices of a rotating calender roll to control the local diameters of the roll.

Many of these previous devices blow jets of hot air from a hot air supply plenum against selected slices of the calender roll to increase the local diameters of the roll and thus decrease the local thickness of the web. Alternatively, when these devices blow jets of cold air from a separate supply plenum against slices of the calender roll, these slices contract. This decreases the local roll diameter and increases the local thickness of the web. Nozzles communicating with the interior of each plenum direct these jets of air against the calender roll. The nozzles are generally disposed at intervals corresponding to adjacent slices of the calender roll whose local diameters are to be controlled. Examples of such devices are shown in U.S. Pat. No. 4,114,528 to Walker and U.S. Pat. No. 3,770,578 to Spurrell.

In these previous devices, the heated air directed by the nozzles against the calender roll is lost to the surrounding atmosphere after it contacts the roll. Thus, these devices loose a relatively large amount of heat energy to their surroundings. In contrast, the apparatus of the present invention recirculates a substantial portion of the heated air after the air contacts the calendar roll. Thus, the device of the present invention is more energy efficient than many previously known calender roll control devices. This and other advantages of the present invention will become apparent in the description which follows.

SUMMARY OF THE INVENTION

The present invention controls local calender roll diameters by directing temperature controlled air against selected slices of a temperature sensitive calender roll. Thermal expansion or contraction, resulting from localized heating or cooling of the calender roll by the temperature controlled air, increases or decreases the local diameters of the roll. The invention conserves heat energy by recirculating the temperature controlled air rather than continually reheating ambient air to the desired temperature.

In one embodiment, the invention comprises a plurality of cold air supply plenums positioned alongside a calender roll. A nozzle associated with each plenum directs a jet of air from the associated plenum toward a slice of the calender roll. Heating elements are associated with each nozzle. Therefore, when the heating elements are energized, the cold air escaping through the nozzles is heated by the heating elements.

A vacuum plenum having an inlet port near the surface of the calender roll returns a portion of the air emitted by each nozzle to the associated air supply plenum. The recycled air may be considerably hotter than room temperature. Thus, recycling the air in this manner conserves heat energy.

In other embodiments of the present invention, nozzles in flow communication with the air supply plenum direct air tangentially into cylindrical chambers so that the air circulates around the cylinders in a circular fashion. The cylinders are dispursed at intervals adjacent to each slice of the calender roll and an opening is cut in the side wall of each cylinder. The cylinders are oriented so that the openings in the wall of each cylinder face the calender roll. Therefore, the air circulating within each cylinder can contact the calender roll where the circular flow of air passes the opening. In this configuration, the circulating air may be heated by heating elements disposed in the air supply plenum, in the nozzles, along the periphery of the cylindrical chambers or in a combination of these locations.

Alternatively, infrared radiation from infrared radiation heat lamps in the cylindrical chambers can heat the calender roll directly in addition to heating the recirculating air. The heat lamps are generally disposed along the axis of each cylinder so that the lamps will not interfere with the circular flow of air and so that infrared radiation can reach the roll through the opening in each cylinder wall. Preferably, however, the cylinders are disposed so that infrared radiation irradiates the calenderable material while the material is in contact with the calender roll. The calenderable material usually has a higher absorptivity for infrared radiation than the calender roll. Therefore, the material is rapidly heated by the infrared radiation from the heat lamp and it subsequently transfers this heat by contact to the calender roll.

Infrared heating introduces the possibility that the web will ignite if the calender rolls unexpectedly stop or slow down so that a section of the web becomes overexposed to infrared radiation. However, the possibility of fire is greatly reduced or eliminated by supplying each cylinder with a fire extinguishing gas such as stack gas instead of air. Stack gas is supplied, for example, from the calendering facility's power plant smoke stack. The gases extracted from the smoke stack usually have a low oxygen content and will not readily support combustion.

A power control device, which may include a computer, can control the heating of each slice of the calender roll to maintain a uniform thickness of calendered material. A sensor measures the thickness of the calendered material at intervals along its width and generates signals corresponding to the measured thickness of the material. The signals from the thickness sensor are fed to the power control device which compares the measured thickness of the calendered material with a desired thickness and adjusts the amount of power supplied to each heating element or infrared heat lamp to thereby control the diameter of each slice of the temperature sensitive calender roll.

DETAILED DESCRIPTION OF THE PREFERRED EMBODIMENTS

Figure 1:
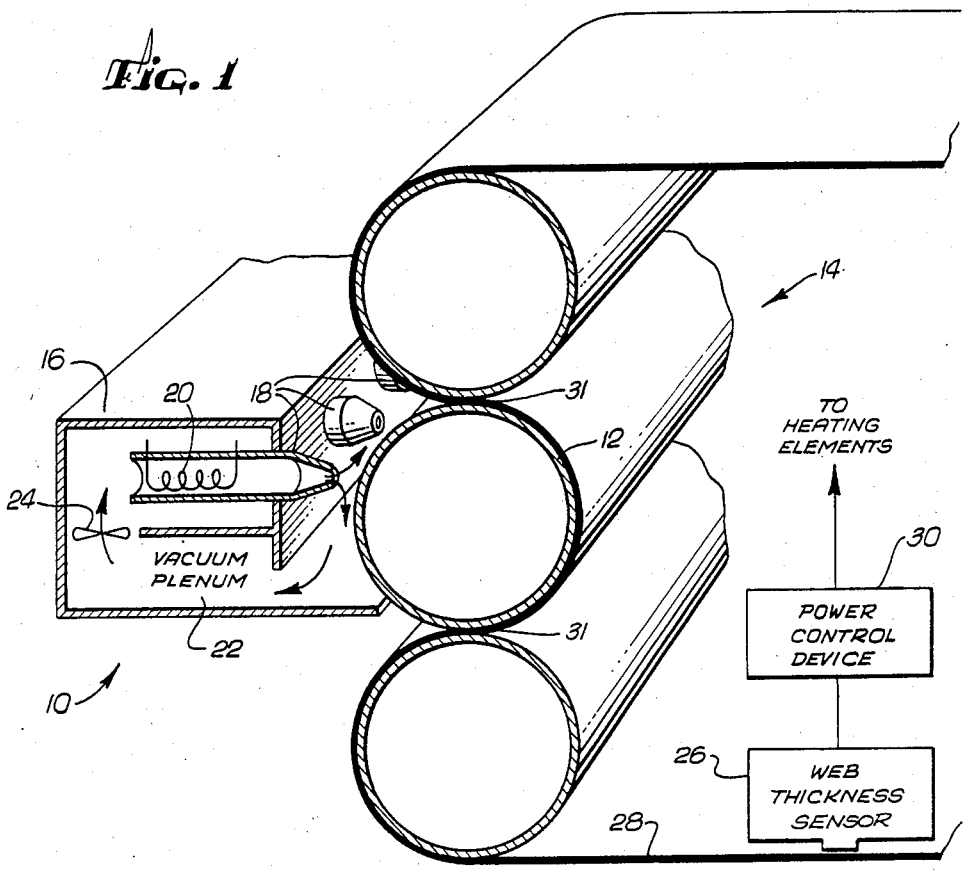
FIG. 1 is a perspective cross-sectional view of one embodiment of the present invention illustrating a plurality of nozzles directing air from cold air supply plenums against a calender roll and vacuum plenums for recirculating the air.

In one embodiment of the present invention, illustrated in FIG. 1, the calender roll control device 10 extends along a roll 12 of the calendering apparatus 14. The device 10 comprises a plurality of cold air supply plenums 16. A nozzle 18 is associated with each plenum 16 and the nozzles 18 are dispersed at six inch intervals along the length of the calender roll 12. The pressurized air in each plenum 16 escapes through the nozzles 18 which direct the air against adjacent slices of the calender roll 12. Electrically resistive heating elements 20 disposed within each nozzle 18 controllably heat the air as the air passes through the nozzles 18.

A separate vacuum plenum 22 recirculates the air emitted by each nozzle 18. Air directed into each vacuum plenum 22 is returned to the associated supply plenum 16 by a blower 24 used for pressurizing the supply plenum 16. In previously known devices, heated air emitted by the nozzles is lost to the surroundings after the air impinges against the calender roll 12. In contrast, the present invention recirculates a portion of the heated air, thus conserving energy.

During operation of the invention, a web thickness sensor 26 measures the thickness of the web 28 and produces a signal corresponding to the measured thickness of each section of web 28. These signals are then fed to a computerized power control device 30 which adjusts the power to the heating elements 20 associated with each nozzle 18 to obtain a web 28 having the desired uniform thickness. An example of a sensor controlled calender roll control device is shown in U.S. Pat. No. 4,114,528 to Walker.

Depending upon the degree of deviation of the web 28 from the desired thickness, more or less power is applied to the heating elements 20 in the nozzles 18 adjacent those slices of the calender roll 12 having diameters that are to be adjusted. When the web thickness sensor 26 detects a thick web section, it sends a signal to the power control device causing it to energize the heating elements in an adjacent nozzle 18, thereby heating the adjacent slice of the calendar roll 12 producing the thick web 28 section. The greater the amount of power applied to the heating elements 20, the more hot air impinges against the calender roll 12 and the more thermal expansion occurs. This decreases the local thickness of the web.

Alternatively, when the web thickness sensor 26 detects a thin web section, the power control device 30 directs less power to the adjacent heating elements 20 or it turns these heating elements 20 completely off. As the power to the heating elements 20 is decreased, the adjacent sections of calender roll 12 are subjected to a flow of colder air. This colder air causes the adjacent sections of the calender roll 12 to contract, thereby increasing the local nip spacing 31 and producing a thicker section of web 28. Of course, a similar system using a web thickness sensor 26 and a computerized power control device 30 may be used with any of the illustrated embodiments to automatically control the thickness profile of the calendered web 28.

Figure 2:
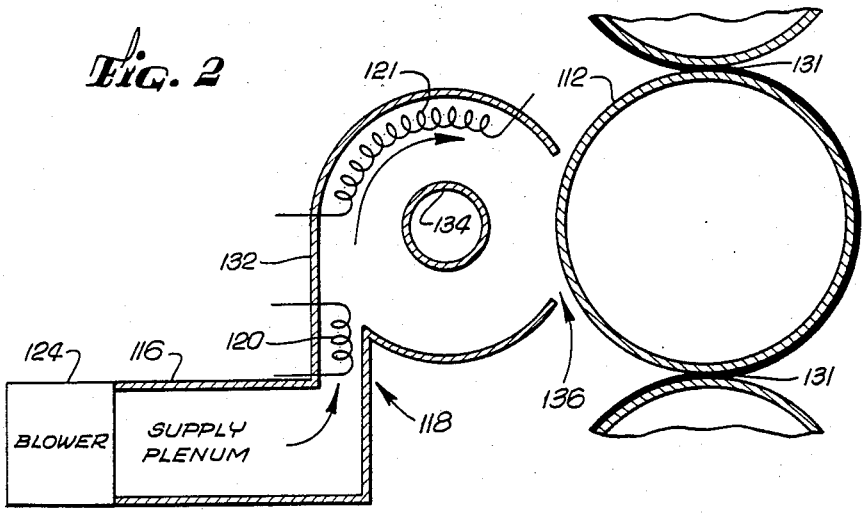
FIG. 2 is a cross-sectional view of another embodiment of the present invention illustrating a cylindrical chamber for recirculating temperature controlled air.

FIG. 2 is a cross-sectional view of another embodiment of the present invention which also recirculates temperature controlled air. In this embodiment, a blower 124 pressurizes a single supply plenum 116 with air. A plurality of nozzles 118 tangentially inject jets of air from the plenum 116 into a series of cylindrical chambers 132 dispursed along the length of the calender roll 112. These jets establish a circular flow of air around optional inner cylinders 134. This recirculating air may then be controllably heated by energizing a heating element 120 within the nozzle 118, a heating element 121 which may be disposed along the inner or outer surface of each cylindrical chamber 132, or by a combination of heaters disposed at the various locations. The elongated axial slot 136 in the cylinder wall allows the recirculating temperature controlled air to contact the surface of the calender roll 112, thereby affecting the temperature of the roll 112 and thus controlling its diameter.

Figure 3:
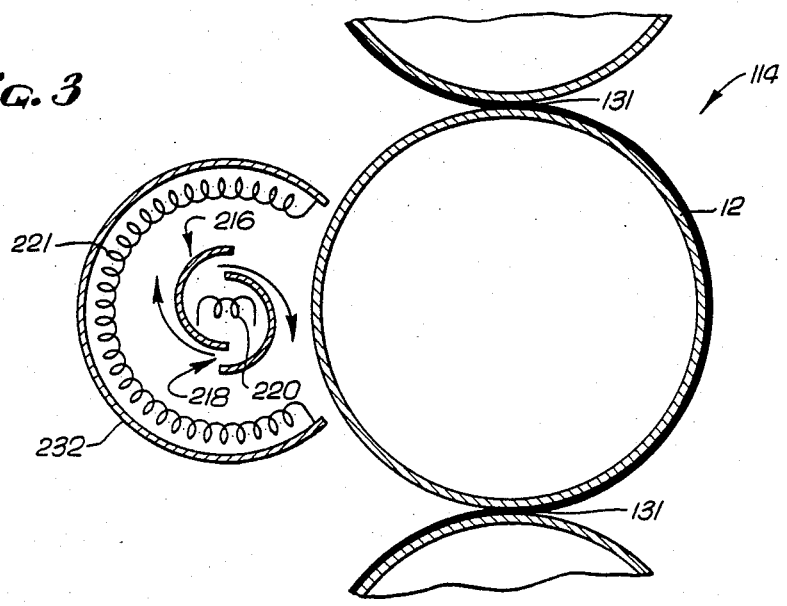
FIG. 3 is a cross-sectional view of still another embodiment of the present invention illustrating a cylindrical chamber for recirculating temperature controlled air and an axially disposed plenum.

FIG. 3 illustrates a third embodiment of the present invention. This embodiment operates in a manner similar to the previously described embodiment. However, an air supply plenum 216 is located in the center of each cylindrical chamber 232 and a plurality of nozzles 218 direct air into the chamber 232 in tangential directions to create a circular flow of air around the plenum 216. As in FIG. 2, a heating element 221 may be located along the periphery of each cylindrical chamber 232. Alternatively, a heating element 220 may be located within each plenum 216 or within each nozzle 218.

Figure 4:
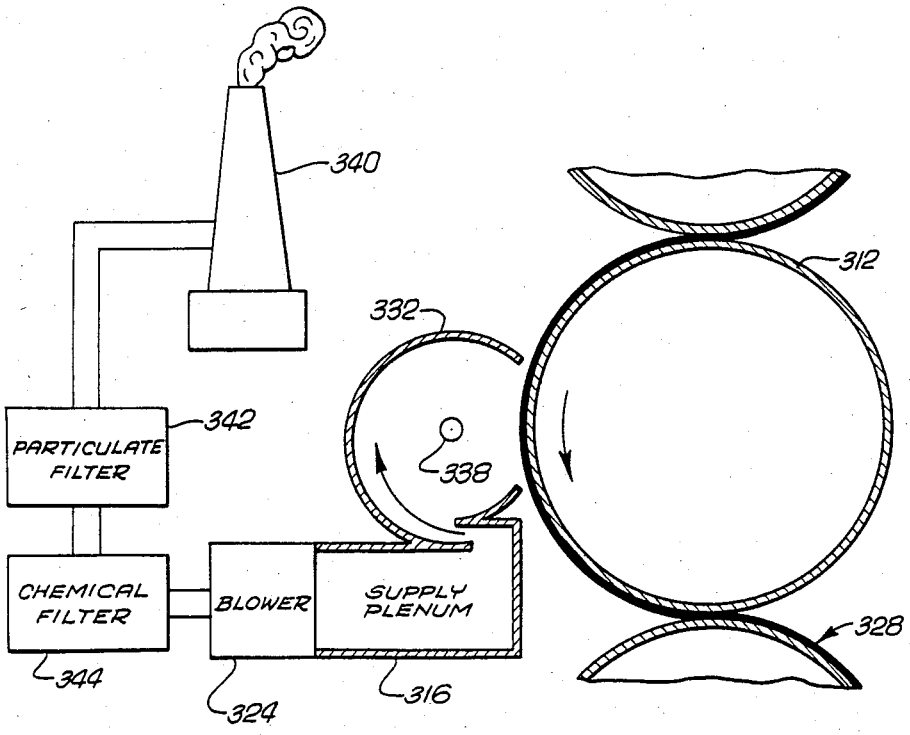
FIG. 4. illustrates an embodiment of the present invention which combines infrared heating of the calender roll with recirculating stack gas to prevent fires.

FIG. 4 is a cross-sectional view of still another embodiment of the present invention. This embodiment operates in a manner similar to the embodiment illustrated in FIG. 2. However, instead of using electrically resistive heaters to heat the air, this embodiment utilizes an infrared radiation heat lamp 338 disposed within each cylindrical chamber 332. The infrared radiation from each heat lamp 338 can heat the surface of the calender roll 312 directly or, as shown in FIG. 4, the device can be disposed so that the heat lamps 338 irradiate the calenderable material 328. The calenderable material 328 usually has a higher absorptivity for infrared radiation than the calender roll 312 which may be polished and highly reflective. Therefore, the material 328 is rapidly heated by the infrared radiation from the heat lamps 338 and it subsequently transfers this heat by contact to the calender roll 312. The infrared radiation from the heat lamp may also be allowed to heat the inner walls of the cylindrical chamber which will in turn heat the gas circulating within the cylinder.

The use of infrared lamps 338 introduces the possibility that the web 328 will ignite if the calender rolls 312 unexpectedly stop or slow down, thereby overexposing a section of the web 328 to infrared radiation. Therefore, to prevent a fire, stack gas, instead of air, is continuously supplied to the cylindrical chamber 332 by a blower 324 and supply plenum 316. The facility smoke stack 340 is usually a convenient source of stack gas. Since the stack gas has already been exposed to combustion, it has a low oxygen content and will not readily support a fire.

The stack gas generally must be purified before it enters the supply plenum 316 since the gas will ultimately be discharged into the work environment around the calender rolls 312. A cloth particulate filter 342 removes particulate matter from the stack gas. This not only prevents soot from being discharged into the work environment but it also prevents the soot in the stack gas from soiling the calenderable material 328. Additionally, a separate chemical filter 344 may contain a catalytic converter of the well known type having a platinum or palladium catalyst for removing carbon monoxide and sulfur dioxide from the stack gas. Alternatively, the stack gas may be bubbled through the filter 344 having an alkaline solution, for example, aqueous sodium carbonate or aqueous sodium hydroxide, to remove the sulfur dioxide from the gas.

Several embodiments of the present invention have been described. Nevertheless, it is understood that one may make various modifications without departing from the spirit and scope of the invention. For example, many types of heaters other than infrared or electrically resistive heaters may be used with the present invention. Additionally, each slice of the temperature controlled calender roll may be longer or shorter than six inches depending on the particular circumstances and the amount of control desired. Furthermore, in addition to the suggested techniques, a variety of filtering techniques may be used to purify the stack gas. Thus, the invention is not limited to the preferred embodiments described herein.

I claim:

1. A calender roll control device of a type which uses heat to control the diameter of a calender roll having a roll diameter which responds to changes in temperture and thereby control the thickness of a sheet of calendered material, the device comprising:

at least one fluid supply plenum;

at least one nozzle in flow communication with the supply plenum for directing jets of fluid at the calender roll;

at least one heating element associated with each nozzle for heating the fluid that flows through the nozzle;

power control means for controlling the amount of power supplied to the heating element;

a vacuum plenum in flow communication with the supply plenum, the vacuum plenum having an inlet port adjacent to the nozzle so that at least a portion of the fluid escaping from the nozzle is directed into the vacuum plenum by suction; and means associated with the plenums for directing fluid from the vacuum plenum into the supply plenum.

2. A calender roll control device as in claim 1, wherein the power control means comprises:

a thickness sensor for measuring the thickness of the calendered material and producing signals in response to the measured thickness of the calendered material; and a power control device for controlling the amount of power supplied to the heating element in response to the signals from the thickness sensor.

3. A calender roll control device as in claim 1, wherein the heating element is disposed within the nozzle.

4. A calender roll control device of a type which uses heat to control the diameter of a calender roll having a roll diameter which responds to changes in temperature and thereby control the thickness of a sheet of calendered material, the device comprising:

at least one hollow generally cylindrical chamber having an opening in the wall of the chamber facing against the calender roll;

a fluid supply plenum in flow communication with the cylindrical chamber;

a nozzle in flow communication between the fluid supply plenum and the cylindrical chamber, wherein the nozzle directs fluid from the fluid supply plenum approximately tangentially into the hollow cylindrical chamber, thereby creating within the cylindrical chamber a circular flow in contact with the calender roll;

pressurizing means for pressurizing the fluid supply plenum with fluid;

a heating element associated with the cylindrical chamber for heating the fluid which flows into the cylindrical chamber; and power control means for controlling the amount of power supplied to the heating element.

5. A calender roll control device as in claim 4, wherein the fluid supply plenum is disposed inside and along the axis of the cylindrical chamber.

6. A calender roll control device as in claim 4, wherein the heating element is disposed along the inner surface of the wall of the hollow cylindrical chamber.

7. A calender roll control device as in claim 4, wherein the heating element is disposed along the outer surface of the wall of the hollow cylindrical chamber.

8. A calender roll control device as in claim 4, wherein the heating element is disposed in the nozzle.

9. A calender roll control device as in claim 4, wherein the power control means comprises:

a thickness sensor for measuring the thickness of the calendered material and producing signals in response to the measured thickness of the calendered material; and a power control device for controlling the amount of power supplied to the heating element in response to the signals from the thickness sensor.

10. A calender roll control device as in claim 4, further comprising a generally cylindrical member in the hollow cylindrical chamber, wherein the cylindrical member is disposed approximately coaxially to the cylindrical chamber, thereby causing the fluid that flows into the hollow cylindrical chamber to flow in a circular manner within the space between the cylindrical chamber and the cylindrical member.

11. A calender roll control device of a type which uses heat to control the diameter of a calender roll having a roll diameter which responds to changes in temperature and thereby control the thickness of a sheet of calenderable material, the device comprising:

at least one hollow generally cylindrical chamber having an opening in the wall of the chamber;

a fluid supply plenum in flow communication with the cylindrical chamber;

a nozzle in flow communication between the fluid supply plenum and cylindrical chamber, wherein the nozzle directs fluid from the plenum approximately tangentially into the cylindrical chamber, thereby creating within the cylindrical chambers a circular flow in contact with the calender roll;

at least one infrared heat lamp disposed inside the cylindrical chamber;

power control means for controlling the amount of power supplied to the heat lamp; and supply means for supplying the plenum with fluid.

12. A calender roll control device as in claim 11, wherein the fluid is stack gas having a low oxygen content.

13. A calender roll control device as in claim 11, wherein the power control means comprises:

a thickness sensor for measuring the thickness of the calenderable material and producing signals in response to the measured thickness of the calenderable material; and a power control device for controlling the amount of power supplied to the heat lamp in response to the signals from the thickness sensor.

14. A calender roll control system of a type which uses heat to control the diameter of a calender roll and thereby control the thickness of a sheet of calenderable material, the system comprising:

a first calender roll having a diameter which responds to changes in temperature;

at least one surface adjacent to the surface of the first calender roll;

calenderable material passing between the first calender roll and the adjacent surface;

at least one hollow generally cylindrical chamber having an opening in the side wall of the chamber and positioned so that the opening faces the first calender roll;

a smoke stack for supplying stack gas to the cylindrical chamber;

a nozzle in flow communication with the chamber, wherein the nozzle directs stack gas approximately tangentially into the cylindrical chamber;

gas transporting means for transporting the stack gas from the smoke stack to the nozzle;

at least one infrared heat lamp disposed in the cylindrical chamber; and power control means for controlling the amount of power supplied to the heat lamp.

15. A calender roll control system as in claim 14, wherein the adjacent surface is the surface of a second calender roll.

16. A calender roll control system as in claim 15, further comprising a filter associated with the gas transporting means for removing particulate material from the stack gas.

17. A calender roll control system as in claim 15, further comprising a chemical filter associated with the gas transporting means, wherein the filter material is selected from the group consisting of platinum, palladium, aqueous sodium carbonate and aqueous sodium hydroxide.

18. A calendar roll control system as in claim 15, wherein the power control means comprises:

a thickness sensor for measuring the thickness of the calenderable material and producing signals in response to the measured thickness of the calenderable material; and a power control device for controlling the amount of power supplied to the infrared heat lamp in response to the signals from the thickness sensor.

19. A method of controlling with heat the diameter of a calender roll and thereby controlling the thickness of a sheet of calenderable material, the method comprising the steps of:

providing a first calender roll having a diameter which responds to changes in temperature;

providing a surface adjacent to the surface of the first calender roll;

passing calenderable material between the first calender roll and the adjacent surface;

directing a flow of fluid at the surface of the first calender roll;

selectively heating the flow of fluid with at least one heater such that the flow of fluid coming in contact with the surface of the first calender roll has different temperature across the surface of the first calender roll;

redirecting at least a portion of the flow of fluid back toward the surface of the first calender roll after the flow contacts the first calender roll surface;

measuring the thickness of the sheet of calenerable material;

comparing the measured thickness of the sheet of calenderable material with a desired thickness; and controlling the amount of heating of the fluid flow based upon differences between the measured thickness of the calenderable material and the desired thickness of the calenderable material.

20. The method of claim 19, wherein the surface adjacent to the surface of the first calender roll is the surface of a second calender roll.

* * * * *